US005472340A

United States Patent [19]

Lynch

[11] Patent Number: 5,472,340

[45] Date of Patent: Dec. 5, 1995

[54] FLARE IGNITER

[76] Inventor: Greg C. Lynch, 270 Grand St., Powell, Wyo. 82435

[21] Appl. No.: 224,686

[22] Filed: Apr. 8, 1994

[51] Int. Cl.[6] ..... F23D 14/06

[52] U.S. Cl. ..... 431/183; 431/266; 431/202

[58] Field of Search ..... 431/181, 183, 431/187, 353, 354, 202, 264, 265, 266, 350

[56] References Cited

U.S. PATENT DOCUMENTS

| | | | |
|---|---|---|---|
| 2,013,979 | 9/1935 | Bray | 431/266 X |
| 2,537,091 | 1/1951 | Rodman et al. . | |
| 2,796,118 | 6/1957 | Parker et al. | 431/265 X |
| 2,992,459 | 7/1961 | Campbell et al. | 431/349 |
| 2,996,113 | 8/1961 | Williams | 431/266 X |
| 3,049,085 | 8/1962 | Musat et al. | 431/183 |
| 3,070,153 | 12/1962 | Flynn | 431/266 |
| 3,404,939 | 10/1968 | Saha | 431/353 X |
| 3,723,049 | 3/1973 | Jurick | 431/183 |
| 4,103,389 | 12/1978 | Kaburagi et al. | 431/183 |
| 4,120,638 | 10/1978 | Straitz, III . | |
| 4,147,498 | 4/1979 | Clarke . | |
| 4,156,591 | 5/1979 | Anderson | 431/354 |
| 4,406,615 | 9/1983 | Guerra et al. . | |
| 4,431,402 | 2/1984 | Hamilton . | |
| 4,450,499 | 5/1984 | Sorelle . | |
| 4,548,576 | 10/1985 | Chesters | 431/349 X |
| 4,711,629 | 12/1987 | MacDonald . | |
| 5,158,442 | 10/1992 | Guerra . | |

FOREIGN PATENT DOCUMENTS

| | | | |
|---|---|---|---|
| 1528806 | 5/1968 | France | 431/349 |
| 2819075 | 10/1979 | Germany | 431/266 |
| 50765 | 7/1930 | Norway | 431/265 |
| 1314813 | 4/1973 | United Kingdom | 431/265 |

*Primary Examiner*—Carl D. Price
*Attorney, Agent, or Firm*—Risto A. Rinne, Jr.

[57] ABSTRACT

An apparatus for the automatic combustion of gas produced from oil and natural gas wells at remote locations is described as including an inner conduit having a first and second end that is disposed within a larger dimension outer conduit, each of which share a parallel longitudinal axis. The inner conduit first end is attached to a source of escaping gas and the second end is disposed within the outer conduit. At least one fin is included in the inner conduit for deflecting a portion of the escaping gas through at least one hole that is provided in the inner conduit. The gas thus deflected passes into the area disposed between the outside of the inner conduit and the inside of the outer conduit where it produces a partial vacuum as it continues to travel in the same general direction out of the outer conduit. The partial vacuum draws ambient air into the outer conduit where at least one slow roll fin is present to agitate the ambient air being drawn therein. The agitated ambient air then encounters and mixes with the gas thus deflected and the remainder of the gas proceeding out of the inner conduit and into the outer conduit to produce a volatile mixture that exits from the outer conduit where it is ignited by an electrode which produces an electrical spark (or arc) intermediate the electrode and the outer conduit. The electrical arc is preferably generated by a solar powered source.

20 Claims, 2 Drawing Sheets

FLARE IGNITER

BACKGROUND OF THE INVENTION

1. Field of the Invention:

The present invention, in general, relates to apparatus used as flare igniters to combust gases prior to venting into the atmosphere and, more particularly, to such devices that are used at remote oil and natural gas well locations and are, preferably, solar powered.

Flare igniters are generally known and include devices that are used to ignite various types of gases produced by natural gas and by oil wells or during the refining process. Known types of flare igniters tend to be somewhat unreliable, especially for use in remote locations.

For example, when the supply of electrical power fails, it is still necessary to combust escaping gases before venting into the atmosphere and certain prior types of devices require that a supply of electrical energy be present for operation.

Certain prior types of flare igniters force either oxygen or ambient air under pressure into the flare igniter to more efficiently combust the escaping gases. However in the event of a power failure air under pressure is no longer available, and therefore such devices either fail to operate or function inefficiently. Not only is it necessary to produce a spark, but the escaping gas must be mixed with ambient air prior to ignition in order to improve combustion efficiency.

Furthermore, certain known types of flare igniters require frequent inspection and maintenance by operators to ensure proper operation. For example, the electrode often wears out prematurely. At certain remote locations, as in remote oil and gas wells, it is not practical to arrange for frequent inspection and maintenance.

Accordingly there exists today a need for a flare igniter that is reliable, and can efficiently combust gas without requiring pressurized air being injected.

2. Description of Prior Art:

Flare igniters are, in general, known. For example, the following patents describe various types of these devices:

U.S. Pat. No. 2,537,091 to Rodman et al, Jan. 9, 1951;

U.S. Pat. No. 4,120,638 to Straitz, III, Oct. 17, 1978;

U.S. Pat. No. 4,147,498 to Clarke, Apr. 3, 1979;

U.S. Pat. No. 4,406,615 to Guerra et al, Sep. 27, 1983;

U.S. Pat. No. 4,431,402 to Hamilton, Feb. 14, 1984;

U.S. Pat. No. 4,450,499 to Sorelle, May 22, 1984;

U.S. Pat. No. 4,711,629 to MacDonald, Dec. 8, 1987; and

U.S. Pat. No. 5,158,442 to Guerra, Oct. 27, 1992.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a flare igniter that is reliable.

It is also an object of the invention to provide a flare igniter that requires minimum maintenance.

Another object of the invention is to provide a flare igniter that operates efficiently.

Still another object of the invention is to provide a flare igniter that is inexpensive to manufacture.

Yet another object of the invention is to provide a flare igniter that does not require air under pressure to be injected into the igniter to permit combustion to occur.

Briefly, a flare igniter that is constructed in accordance with the principles of the present invention has an inner conduit having a first end and a second end. The first end of the inner conduit is adapted for connection to receive a discharge of gas, under pressure, to be burned before it is vented into the surrounding atmosphere. The inner conduit second end is disposed inside an outer conduit, the outer conduit having an outer conduit first end and an outer conduit second end and being disposed generally around the inner conduit wherein both the inner conduit and the outer conduit share a parallel longitudinal axis. The outer conduit first end is disposed over the inner conduit and is intermediate with respect to the inner conduit first end and the inner conduit second end. The inner conduit second end is disposed within the outer conduit and is intermediate with respect to the outer conduit first end and the outer conduit second end. The inner conduit second end includes at least one fin for deflecting a portion of the gas from the inner conduit into the area disposed between the inner conduit and the outer conduit whilst still forcing the gas in a direction that is generally towards the outer conduit second end. The portion of the gas that is thus deflected into the area disposed between the inner conduit and the outer conduit forces the ambient air that was disposed therein to move towards the outer conduit second end. Accordingly a partial vacuum is created in the area disposed between the inner conduit and the outer conduit which draws additional ambient air into the portion of the outer conduit first end that is exposed to the surrounding atmosphere. The ambient air thus entering passes by at least one slow roll fin which gently swirls and agitates the incoming ambient air thereby mixing the incoming ambient air with the portion of the gas that is thus deflected into the area disposed between the inner conduit and the outer conduit, thus producing a volatile mixture of gas and ambient air. The portion of the gas not deflected into the area disposed between the inner conduit and the outer conduit is discharged out of the inner conduit second end where it further mixes with the volatile mixture of the ambient air and the portion of the deflected gas. The entire mixture of gas and ambient air continues to move within the outer conduit generally towards the outer conduit second end. Disposed at the second end of the outer conduit is provided a method to periodically produce an electrical spark (arc) between an electrode and the second end of the outer conduit thereby igniting the mixture of ambient air and gas. The preferred method to produce the electrical spark includes a solar powered source. Accordingly, as the pressure and the discharge rate of the gas increases, the partial vacuum produced also increases, thereby drawing proportionately more ambient air into the outer conduit, and correspondingly agitating the ambient air and gas mixture proportionately more to ensure adequate combustion of the gas prior to the venting thereof into the atmosphere.

DETAILED DESCRIPTION OF THE INVENTION

Figure 1:
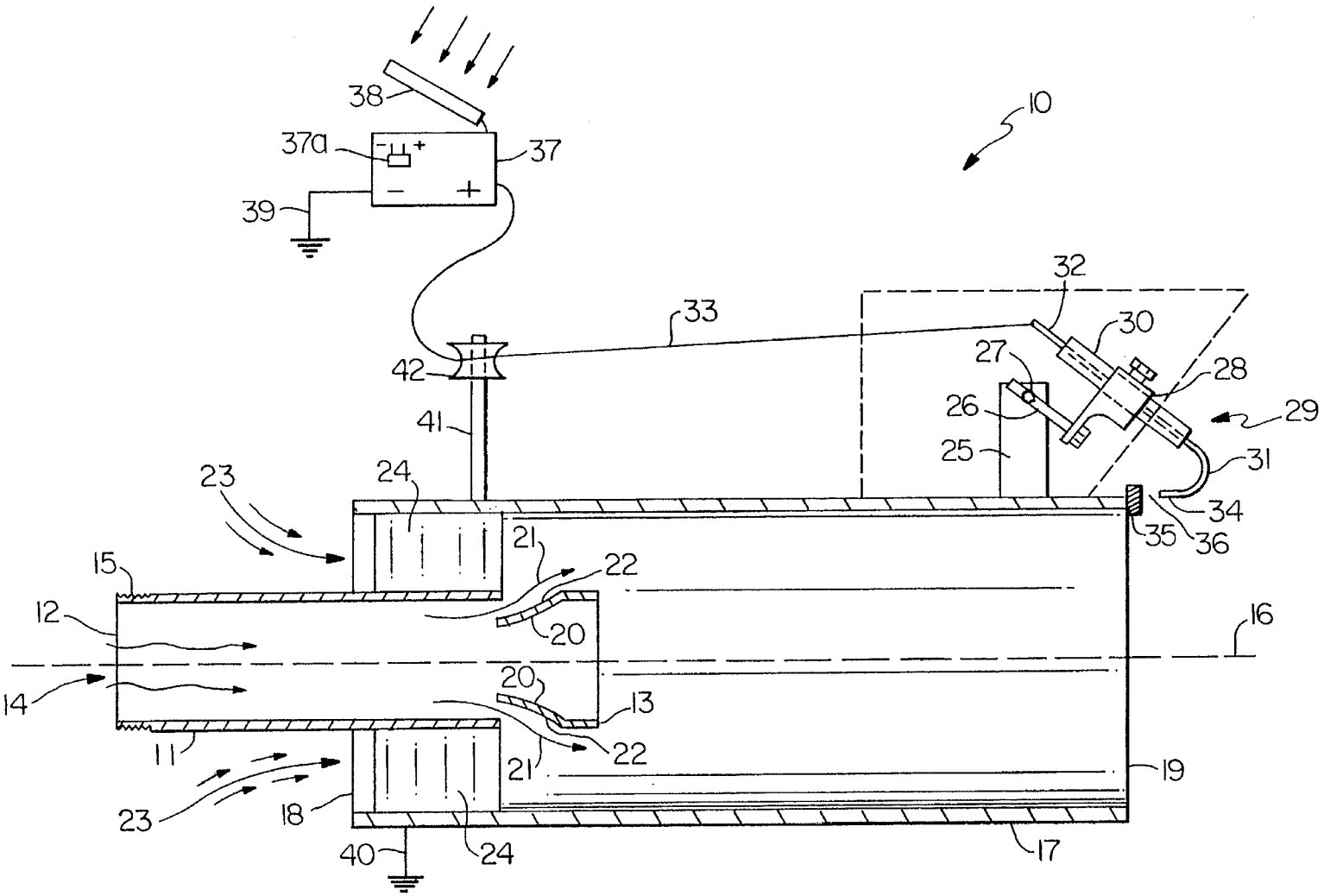
FIG. 1 is a view in cross section of the flare igniter.

Referring to FIG. 1 is shown, a flare igniter, identified in general by the numeral 10.

An inner conduit 11 is provided having a first end 12 and a second end 13. The inner conduit first end 12 is adapted for connection to receive a gas, identified in general by the reference numeral 14, to be burned under pressure and, as shown, includes screw threads 15.

The inner conduit includes a longitudinal axis, shown as a dashed line, and identified in general by the reference numeral 16.

Disposed around the inner conduit 11 and having either the longitudinal axis 16 or a parallel longitudinal axis (not shown) with respect to the longitudinal axis 16 is provided an outer conduit 17 having an outer conduit first end 18 and an outer conduit second end 19.

The outer conduit first end 18 is disposed over and intermediate the inner conduit first end 12 and the inner conduit second end 13. The inner conduit second end 13 is disposed within and intermediate the outer conduit first end 18 and the outer conduit second end 19.

Gas, under pressure, enters into the inner conduit first end 12 and is directed generally toward the inner conduit second end 13.

Disposed near the inner conduit second end 13 are provided one or more deflecting fins 20 which extend within the area as is defined by the interior of the inner conduit 11. The deflecting fins deflect a portion of the gas, identified in general by reference numeral 21, from within the inner conduit 11 through one or more holes 22 provided through the inner conduit 11 into the area that is disposed between the inner conduit second end 13 and the outer conduit 17.

The portion of the deflected gas 21 is directed generally in a direction that is toward the outer conduit second end 19, and accordingly, produces a partial vacuum in the area disposed between the inner conduit 11 and the outer conduit 17.

The partial vacuum draws ambient air, identified in general by the reference numeral 23, into the area disposed between the inner conduit 11 and the outer conduit 17 at the outer conduit first end 18 which is exposed to the surrounding atmosphere.

Figure 2:
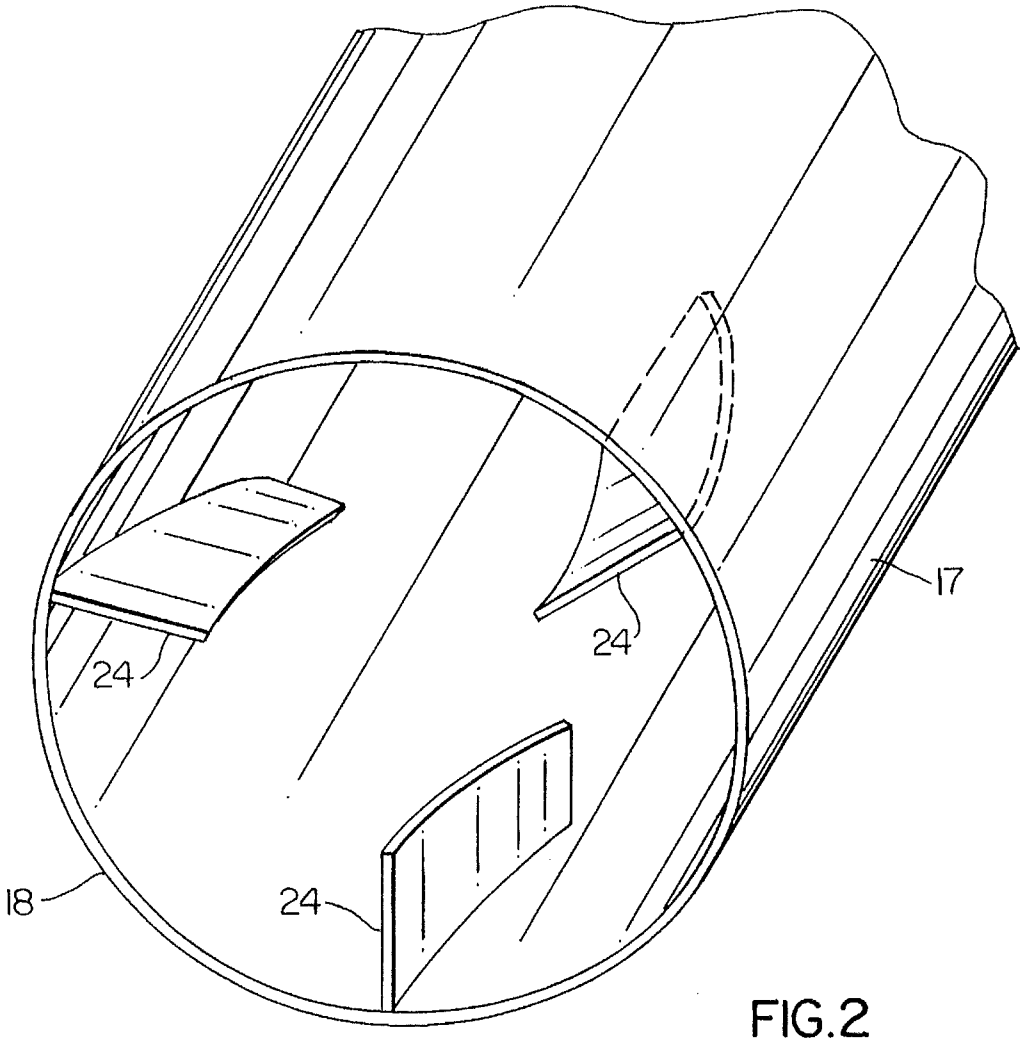
FIG. 2 is a view in perspective of the first end of the outer conduit without the inner conduit present.

Referring also to FIG. 2, the ambient air 23 being thus drawn in by the partial vacuum produced encounters one or more slow roll fins 24 that are disposed near to the outer conduit first end 18. The slow roll fins 24 have a gentle curvature thereto, and serve to swirl the ambient air 23 as much as possible as it enters, but without causing an excessive restriction to the passage of ambient air 23 entering therein.

The swirling ambient air 23 being drawn into the area disposed between the inner conduit 11 and the outer conduit 17 passes beyond the slow roll fins 24 and mixes with the portion of the deflected gas 21 that has been deflected to the area that is also disposed between the inner conduit second end 13 and the outer conduit 17.

It is necessary to combine oxygen, either as a pure oxygen gas or as a part of the ambient air 23, with the gas 14 that is to be burned in order to allow for combustion to occur.

Ideally to encourage complete combustion an adequate amount of oxygen must be present before the gas 14 and ambient air 23 mixture is ignited. (The method by which it is ignited is described in greater detail hereinbelow.)

Less than complete combustion of the gas 14 and ambient air 23 mixture will result in the discharge of unburned gas 14 out of the outer conduit second end 19 into the atmosphere where it can have a deleterious effect. Accordingly standards promulgated by the Environmental Protection Agency (EPA) and by other regulatory bodies are tending to require that increasingly more complete combustion of the gas 14 be made to occur.

As a greater discharge of gas 14 occurs into the flare igniter 10, the greater is the portion of the deflected gas 21 that is generated, thereby causing the partial vacuum to increase accordingly. A stronger partial vacuum draws more ambient air 23 into the the flare igniter 10, thereby automatically regulating the supply of ambient air 23 in proportion to the amount of gas 14 to be burned.

It is noted that the flare igniter 10 draws in ambient air 23 as a result of the partial vacuum created by the portion of the deflected gas 21. Accordingly, it is not necessary to inject air (oxygen) under pressure into the flare igniter 10 to ensure that efficient combustion of the gas 14 occurs.

Because air (oxygen) under pressure is not required, the mixing of ambient air 23 with the gas 14 is able to occur without any additional power source, such as electrical power, to be present. The makes the use of the flare igniter 10 especially desirable in remote locations without a source of electrical power, or in areas where the supply of electrical power is subject to interruption.

Of course those now skilled by benefit of the present disclosure will recognize that other design factors are varied to better adapt the flare igniter 10 to the particular application.

For example, the length and diameters of the inner conduit 11 and the outer conduit 17 are varied. Similarly, the number, size, shape, and general attributes of the deflecting fins 20 and of the the slow roll fins 24 are varied as are the size and quantity of holes 22 provided through the inner conduit 11, any or all of which may be varied to provide the optimum combustion of the gas 14 that is possible.

Attached near the outer conduit second end 19 and to the outside of the outer conduit 17 is an electrode mounting bracket 25. The electrode mounting bracket 25 includes a second mounting bracket 26 pivotally attached thereto by a nut and bolt 27 at an end of the electrode mounting bracket 25 opposite to where the bracket 25 is attached to the outer conduit 17. A third mounting bracket 28 is pivotally attached to an end of the second mounting bracket 26 that is disposed generally away from where the second mounting bracket 26 is attached to the electrode mounting bracket 25.

The third mounting bracket 28 includes a center opening that is adapted to receive an electrode assembly 29 therein. The electrode assembly 29 includes an outer insulator 30 having an inner electrode 31 passing therein.

The inner electrode 31 includes a first electrode end 32 that is adapted to receive an electrical conductor 33 and a second electrode end 34 that includes an arcuate portion which serves to face the second electrode end 34 toward a sparking surface 35 that is attached to the outer conduit second end 19.

Preferably, the sparking surface 35 is formed of a material that is affixed to the outer conduit second end 19 to decrease wear caused by repeated electrical arcs occurring in a potentially corrosive atmosphere. Depending upon what particular type and mixture of the gas 14 that is being discharged, the atmosphere may indeed be highly corrosive.

The sparking surface 35 is preferably stainless steel that is either welded or brazed upon the outer conduit second end 19. The stainless steel sparking surface 35 decreases the rate by which this surface is eroded, or wears away, and accordingly prolongs the time duration by which a spark gap 36, as is described in greater detail hereinbelow, is maintained.

For similar reasons, the second electrode end 34 is preferably constructed of either stainless steel or has a stainless steel coating affixed thereto.

The electrode mounting bracket 25, the second mounting bracket 26, and the third mounting bracket 28 allow for the precise positioning of the electrode assembly 29 in the proper orientation with respect to the outer conduit second end 19.

In particular the distance separating the stainless steel sparking surface 35 from the second electrode end 34 is important to control for this distance serves to form the spark gap 36. During use a periodic surge in electrical voltage is produced in a manner as is described in greater detail hereinbelow which causes an electrical arc to be produced across the spark gap 36.

Accordingly if the spark gap 36 were too small either no electrical arc would be produced or the arc would be so small as to occasionally fail to combust the mixture of the ambient air 23 and the gas 14. Conversely if the spark gap 36 were too large, it is possible that the voltage produced would be insufficient to generate an electrical arc thereby preventing combustion from occurring.

Preferably the spark gap 36 is set to an optimum amount and the stainless steel sparking surface 35 and the stainless steel second electrode end 34 prolong the time interval by which the proper spark gap 36 is maintained.

The end of the electrical conductor 33 that is not attached to the first electrode end 32 of the inner electrode 31 is attached to an output (hot or "+" side) of a solar powered source 37 that is capable of producing a periodic surge in voltage sufficient to produce the electrical arc, as was described hereinabove, across the spark gap 36.

Detail as to construction of the solar powered source 37 is not required as such products are commercially available at present, although they are not marketed for the purpose as is herein described.

For example, a solar powered fence charger is a type of commercially available product which produces a periodic surge in voltage that is used to confine livestock within a predetermined area. In normal use, the solar powered fence charger has an internal storage battery 37*a*, solar panels 38 that are adapted to convert solar insolation into electrical energy, and circuitry adapted for charging the storage battery as well as having circuitry for producing a periodic surge in voltage. The solar powered source 37 must similarly have, at a minimum, these component parts.

The solar powered fence charger is adaptable for use as the solar powered source 37 of the flare igniter 10 without any modification required thereto. The solar powered source 37 includes a ground wire 39 that is typically attached as a electrical ground to the earth. The ground wire 39 provides an electrical reference for the voltage surges (output) that appear on the electrical conductor 33 of the solar powered source 37.

Similarly the flare igniter 10 must include a second ground wire 40 that is also typically attached as a electrical ground to the earth so as to provide a corresponding reference of the flare igniter 10 with respect to the solar powered source 37. 0f course, if preferred, the ground wire 39 of the solar powered source 37 may be attached directly to the second ground wire 40 of the flare igniter 10 to provide the necessary electrical reference between the two devices without having to reference either device to the earth.

An insulator post 41 attached to the outside surface of the outer conduit 17 and an insulator 42 attached thereto are provided, as desired, for routing the electrical conductor 33 away from close proximity with respect to any portion of the flare igniter 10 wherein an inadvertent electrical arc might otherwise be produced if the electrical conductor 33 were to approach some part of the flare igniter 10.

A cover 43, shown in dashed lines in FIG. 1, is provided as an optional component part that is disposed around the electrode mounting bracket 25, the second mounting bracket 26, the third mounting bracket 28, and the electrode assembly 29 to protect these components from the wind and from the elements in general.

During normal use the periodic voltage surges that are produced by the solar powered source 37 are conveyed through the electrical conductor 33 and to the inner electrode 31 of the electrode assembly 29. Once sufficient voltage is attained to ionize the gas 14 and ambient air 23 mixture, an electrical arc is produced intermediate the second electrode end 34 and the sparking surface 35 across the spark gap 36. The electrical arc thus produced ignites the gas 14 and ambient air 23 mixture which in turn is then combusted.

Combustion continues for as long as a fuel and oxygen source is present. However, as normally occurs, the supply of gas 14 is occasionally interrupted, and combustion is extinguished.

However, the periodic voltage surges that are produced by the solar powered source 37 cause simultaneous periodic electrical arcs to be produced thereby ensuring that whatever gas 14 is released is adequately combusted. Of course the time interval between the periodic voltage surges that are produced is selected by proper design of the solar powered source 37 so as to ensure that a sufficient quantity of electrical arcs are produced to adequately combust any of the gas 14 that is present.

The relationship of the outer conduit 17 with respect to the inner conduit 11 has been described hereinabove. It is of course necessary to maintain that physical relationship during use. Accordingly the outer conduit 17 is attached so as to maintain its relationship with respect to the inner conduit 11 by whatever method is preferred.

For example, the outer conduit 17 can be attached by welding directly to the slow roll fins 24 or by bolting to a flange (not shown) that is attached to the slow roll fins 24. The slow roll fins 24 can be attached by welding directly to the inner conduit 11 or by bolting to a flange (not shown) that is attached to the inner conduit 11. Or if preferred additional intermediate internal posts (not shown) are attached at one end each thereof to the inner conduit 11 and are attached at a remaining end each thereof to the outer conduit 17.

While the flare igniter 10 is particularly well suited for use with the solar powered source 37, certain applications will benefit from the structure, as was described hereinabove, when any preferred method for producing an electrical arc is utilized to combust the gas 14.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A flare igniter for igniting and combusting a gas prior to the release of said gas into the ambient atmosphere, comprising:

(a) an inner conduit having an inner conduit first end and an inner conduit second end and an inside dimension and an outside dimension and a longitudinal axis;

(b) means for attaching said inner conduit first end to a supply of said gas to be combusted wherein said gas enters said inner conduit at said inner conduit first end;

(c) an outer conduit having an inside dimension larger than said outside dimension of said inner conduit and having an outer conduit first end and an outer conduit second end wherein said outer conduit first end is disposed over said inner conduit and intermediate said inner conduit first end and said inner conduit second end, and said inner conduit second end is disposed within said outer conduit and intermediate said outer conduit first end and said outer conduit second end, and wherein said outer conduit includes an outer conduit longitudinal axis that is parallel with said longitudinal axis of said inner conduit;

(d) at least one deflecting fin disposed in said inner conduit, said at least one deflecting fin extending into said inner conduit for deflecting a portion of said gas entering said inner conduit through at least one hole provided through said inner conduit into an area that is disposed between said outside dimension of said inner conduit and said inside dimension of said outer conduit;

(e) at least one slow roll fin that is disposed within the area between said outside dimension of said inner conduit and said inside dimension of said outer conduit, said at least one slow roll fin having a curvature thereto; and (f) means for producing an electrical arc at said outer conduit second end, wherein said means for producing an electrical arc includes means for periodically producing a surge in voltage capable of producing an electrical arc on an electrical output terminal relative to an electrical ground.

2. The flare igniter as defined by claim 1 wherein said means for periodically producing a surge in voltage includes a storage battery, at least one solar panel adapted for converting solar insolation into electrical energy, and means for charging said storage battery using said electrical energy, an electrical circuit adapted for periodically producing said surge in voltage from said electrical energy, and means for providing a reference of said electrical ground with respect to said outer conduit, said means for producing an electrical arc electrically connected to said electrical output terminal.

3. The flare igniter as defined by claim 2 wherein said means for periodically producing a surge in voltage includes a solar powered fence charger.

4. The flare igniter as defined by claim 1 wherein said means for attaching includes screw threads.

5. The flare igniter as defined by claim 1 wherein said means for producing an electrical arc includes an electrode disposed a predetermined distance from said outer conduit second end.

6. The flare igniter as defined by claim 5 wherein said outer conduit second end includes a sparking surface attached to said outer conduit.

7. The flare igniter as defined by claim 6 wherein said sparking surface is welded to said outer conduit.

8. The flare igniter as defined by claim 6 wherein said sparking surface is brazed to said outer conduit.

9. The flare igniter as defined by claim 6 wherein said sparking surface is formed of stainless steel.

10. The flare igniter as defined by claim 5 wherein said electrode is formed of stainless steel.

11. The flare igniter as defined by claim 5 wherein a portion of said electrode is covered with stainless steel.

12. The flare igniter as defined by claim 5 including means for adjusting the position of said electrode with respect to said outer conduit.

13. The flare igniter as defined by claim 12 wherein said means for adjusting includes a first bracket attached to said outer conduit at one end thereof, a second bracket pivotally attached to said first bracket, and a third bracket pivotally attached to said second bracket, and means for attaching said electrode to said third bracket.

14. The flare igniter as defined by claim 1 including a cover disposed generally over said said means for producing an electrical arc.

15. The flare igniter as defined by claim 1 including at least one post attached to said outer conduit and an insulator attached to said at least one post, said insulator adapted to receive an electrical conductor.

16. A flare igniter for igniting and combusting a gas prior to the release of said gas into the ambient atmosphere, comprising:

(a) an inner conduit having an inner conduit first end and an inner conduit second end and an inside dimension and an outside dimension and a longitudinal axis;

(b) means for attaching said inner conduit first end to a supply of said gas to be combusted wherein said gas enters said inner conduit at said inner conduit first end;

(c) an outer conduit having an inside dimension larger than said outside dimension of said inner conduit and having an outer conduit first end and an outer conduit second end wherein said outer conduit first end is disposed over said inner conduit and intermediate said inner conduit first end and said inner conduit second end, and said inner conduit second end is disposed within said outer conduit and intermediate said outer conduit first end and said outer conduit second end, and wherein said outer conduit includes an outer conduit longitudinal axis that is parallel with said longitudinal axis of said inner conduit;

(d) at least one deflecting fin disposed in said inner conduit, said at least one deflecting fin extending into said inner conduit for deflecting a portion of said gas entering said inner conduit through at least one hole provided through said inner conduit into an area that is disposed between said outside dimension of said inner conduit and said inside dimension of said outer conduit;

(e) at least one slow roll fin that is disposed within the area between said outside dimension of said inner conduit and said inside dimension of said outer conduit, said at least one slow roll fin having a curvature thereto;

(f) means for periodically producing a surge in voltage capable of producing an electrical arc on an electrical output terminal relative to an electrical ground, said means for periodically producing a surge in voltage including a storage battery, at least one solar panel adapted for converting solar insolation into electrical energy, and means for charging said storage battery using said electrical energy, an electrical circuit adapted for periodically producing said surge in voltage from said electrical energy, and means for providing a reference of said electrical ground with respect to said outer conduit; and (g) means for producing an electrical arc at said outer conduit second end, said means for producing an electrical arc electrically connected to said electrical output terminal.

17. The flare igniter as defined by claim 16 wherein said means for periodically producing a surge in voltage includes a solar powered fence charger.

18. The flare igniter as defined by claim 16 wherein said means for producing an electrical arc includes an electrode disposed a predetermined distance from said outer conduit second end.

19. The flare igniter as defined by claim 18 wherein said outer conduit second end includes a sparking surface attached to said outer conduit.

20. The flare igniter as defined by claim 18 including means for adjusting the position of said electrode with respect to said outer conduit.

* * * * *